US011261013B2

(12) United States Patent
Smalley

(10) Patent No.: US 11,261,013 B2
(45) Date of Patent: Mar. 1, 2022

(54) CARRIER FOR CONTAINERS

(71) Applicant: Graphic Packaging International, LLC, Atlanta, GA (US)

(72) Inventor: Brian Smalley, Bristol (GB)

(73) Assignee: Graphic Packaging International, LLC, Atlanta, GA (US)

( * ) Notice: Subject to any disclaimer, the term of this patent is extended or adjusted under 35 U.S.C. 154(b) by 30 days.

(21) Appl. No.: 16/598,282

(22) Filed: Oct. 10, 2019

(65) Prior Publication Data

US 2020/0189821 A1 Jun. 18, 2020

Related U.S. Application Data

(63) Continuation-in-part of application No. 16/426,066, filed on May 30, 2019.

(60) Provisional application No. 62/841,449, filed on May 1, 2019, provisional application No. 62/817,120, filed on Mar. 12, 2019, provisional application No. 62/814,412, filed on Mar. 6, 2019, provisional application No. 62/810,015, filed on Feb. 25, 2019, provisional application No. 62/797,585, filed on Jan. 28, 2019, provisional application No. 62/796,830, (Continued)

(51) Int. Cl.
*B65D 71/44* (2006.01)
*B65B 17/02* (2006.01)

(52) U.S. Cl.
CPC ..... *B65D 71/44* (2013.01); *B65B 17/025* (2013.01)

(58) Field of Classification Search
CPC ..... B65D 71/48; B65D 71/0003; B65D 2571/0066; B65D 2571/00716; B65D 2571/00925; B65D 2571/00932; B65D 71/12; B65D 71/42; B65D 71/44; B65D 75/00; B65D 75/04
USPC ..... 206/147, 151–155
See application file for complete search history.

(56) References Cited

U.S. PATENT DOCUMENTS 1,527,399 A 2/1925 Davidson
2,289,859 A 7/1942 Arthur
(Continued)

FOREIGN PATENT DOCUMENTS

AT 399701 B 7/1995
CA 2133827 10/1993
(Continued)

OTHER PUBLICATIONS

European Search Report for EP 19 18 0436 dated Jan. 22, 2020.
(Continued)

*Primary Examiner* — Chun Hoi Cheung
(74) *Attorney, Agent, or Firm* — Womble Bond Dickinson (US) LLP

(57) ABSTRACT

A carrier for holding a plurality of containers, the carrier includes a plurality of panels that includes a top panel, at least one central panel, and at least one attachment panel configured to receive a portion of one or more containers of the plurality of containers, the at least one central panel is for being positioned between and attached to adjacent containers of the plurality of containers. The carrier also includes at least one access feature that is positionable for allowing access to at least one container of the plurality of containers, the at least one access feature includes a marginal portion of the top panel and a marginal portion of the at least one attachment panel.

43 Claims, 11 Drawing Sheets

Related U.S. Application Data filed on Jan. 25, 2019, provisional application No. 62/783,752, filed on Dec. 21, 2018, provisional application No. 62/779,689, filed on Dec. 14, 2018.

(56) References Cited

U.S. PATENT DOCUMENTS 2,320,440 A 6/1943 Kruea
2,331,038 A * 10/1943 Meller ..... B65D 71/42 211/73
2,397,376 A 3/1946 Caldwell
2,397,716 A 4/1946 Wendler
2,522,950 A 9/1950 Keith
2,594,376 A 4/1952 Arneson
2,594,377 A 4/1952 Arneson
2,737,326 A 3/1956 Toensmeier
2,798,603 A 7/1957 Grinspoon
2,950,041 A 8/1960 Stone
2,965,410 A 12/1960 Hughes
3,001,647 A 9/1961 Liss
3,046,711 A 7/1962 Harrison
3,061,141 A 10/1962 Cote
3,099,475 A * 7/1963 Manizza ..... B65D 71/42 294/87.2
3,118,537 A 1/1964 Copping
3,137,109 A 6/1964 Rapata
3,146,885 A 9/1964 Grantham
3,200,944 A 8/1965 Rapata
3,245,711 A 4/1966 Dantoin
3,281,180 A 10/1966 Spery
3,302,784 A 2/1967 Copping
3,387,879 A 6/1968 Wood
3,432,202 A 3/1969 Ebelhardt
3,463,535 A 8/1969 Beart
3,528,697 A 9/1970 Wood
3,587,847 A 6/1971 Graser
3,601,439 A 8/1971 Poupitch
3,627,121 A 12/1971 Deasy
3,653,503 A * 4/1972 Arneson ..... B65D 71/42 206/153
3,693,787 A 9/1972 Duerr
3,701,416 A * 10/1972 Lawrence ..... B65D 71/42 206/153
3,726,558 A 4/1973 Klygis
3,734,278 A 5/1973 Kerrigan
3,876,066 A 4/1975 Klygis
3,897,873 A 8/1975 Graser
3,924,739 A 12/1975 Gravesteijn
3,942,631 A 3/1976 Sutherland et al.
4,029,204 A 6/1977 Manizza
4,111,298 A 9/1978 Mascia
4,120,396 A 10/1978 Mascia
4,136,772 A 1/1979 Mascia
4,155,502 A 5/1979 Forte
4,190,149 A 2/1980 Oliff et al.
4,244,617 A 1/1981 Manizza
4,304,329 A 12/1981 Graser
4,339,032 A 7/1982 Wood
4,372,599 A 2/1983 Kiedaisch et al.
4,378,879 A 4/1983 Killy
4,382,505 A 5/1983 Sutherland et al.
4,441,611 A 4/1984 Sommariva
4,471,870 A 9/1984 Uhlig
4,523,676 A 6/1985 Barrash
4,784,266 A 11/1988 Chaussadas
4,911,288 A 3/1990 Dantoin, Jr.
4,974,726 A 12/1990 Klygis et al.
5,002,225 A 3/1991 Bienaime
5,065,862 A 11/1991 Mousseau
5,103,971 A 4/1992 Schuster
5,125,506 A 6/1992 Galbierz et al.
5,139,147 A 8/1992 Sutherland
5,188,225 A 2/1993 Jorba
5,193,673 A 3/1993 Rathbone et al.
5,201,412 A 4/1993 Schuster et al.
5,230,425 A 7/1993 Edqvist et al.
5,246,113 A 9/1993 Schuster
5,263,299 A 11/1993 Galbierz et al.
5,267,644 A 12/1993 Tsao
5,282,348 A 2/1994 Dampier et al.
5,297,673 A 3/1994 Sutherland
5,310,050 A 5/1994 Sutherland
5,310,051 A 5/1994 Sutherland
5,314,224 A 5/1994 Bates
5,318,178 A 6/1994 Davies et al.
5,323,895 A 6/1994 Sutherland et al.
5,328,024 A 7/1994 Sutherland
5,335,774 A 8/1994 Ganz
5,351,815 A 10/1994 Fogle et al.
5,351,816 A 10/1994 Sutherland et al.
5,351,817 A 10/1994 Sutherland
5,355,999 A 10/1994 Sutherland
5,360,104 A 11/1994 Sutherland
5,390,784 A 2/1995 Sutherland
5,407,065 A 4/1995 Sutherland
5,415,278 A 5/1995 Sutherland
5,443,153 A 8/1995 Sutherland
5,445,262 A 8/1995 Sutherland
5,452,799 A 9/1995 Sutherland
5,484,053 A 1/1996 Harris
5,485,914 A 1/1996 Martin
5,487,464 A 1/1996 Galbierz et al.
5,490,593 A 2/1996 Gordon et al.
5,503,267 A 4/1996 Sutherland
5,520,283 A 5/1996 Sutherland
5,524,756 A 6/1996 Sutherland
5,551,566 A 9/1996 Sutherland
5,553,704 A 9/1996 Gordon et al.
5,553,705 A 9/1996 Bakx
5,590,776 A 1/1997 Galbierz
5,593,027 A 1/1997 Sutherland
5,609,247 A 3/1997 Appleton
5,609,379 A 3/1997 Harrelson
5,682,982 A 11/1997 Stonehouse
5,706,936 A 1/1998 Bernstein
5,711,419 A 1/1998 Beales et al.
5,735,394 A 4/1998 Harrelson
5,746,310 A 5/1998 Slomski
5,762,193 A 6/1998 Marco
5,791,463 A 8/1998 Negelen
5,816,391 A 10/1998 Harris
5,845,776 A 12/1998 Galbierz et al.
5,878,876 A 3/1999 Galbierz et al.
5,960,945 A 10/1999 Sutherland
6,039,181 A 3/2000 Whiteside
6,059,099 A 5/2000 Galbierz
6,082,532 A 7/2000 Miess
6,145,656 A 11/2000 Marco
6,315,111 B1 11/2001 Sutherland
6,394,272 B1 5/2002 Domansky
6,896,130 B2 5/2005 Theelen
D506,925 S 7/2005 Plumer
7,011,209 B2 3/2006 Sutherland et al.
7,690,507 B2 4/2010 Sutherland
7,721,878 B2 5/2010 Requena
7,762,397 B2 7/2010 Coltri-Johnson et al.
7,789,231 B2 9/2010 Requena
7,823,721 B2 11/2010 Sutherland et al.
8,096,413 B2 1/2012 DePaula
8,162,135 B2 4/2012 Oliveira
8,353,398 B2 1/2013 DePaula et al.
8,387,784 B2 3/2013 Gonzalez et al.
8,443,968 B2 5/2013 DePaula
8,464,866 B2 6/2013 Sutherland et al.
8,469,184 B2 6/2013 Spivey, Sr.
8,602,209 B2 12/2013 Jones et al.
8,631,932 B2 1/2014 Holley, Jr.
8,701,878 B2 4/2014 Spivey, Sr.
8,925,720 B2 1/2015 Sutherland et al.
8,936,149 B2 1/2015 Smalley
8,955,674 B2 2/2015 Spivey, Sr. et al.
9,079,699 B2 7/2015 Holley, Jr.
9,169,050 B2 10/2015 Spivey, Sr.
9,359,093 B2 6/2016 DePaula et al.

(56) References Cited

U.S. PATENT DOCUMENTS

| | | | |
|---|---|---|---|
| 9,446,891 | B2 | 9/2016 | Jones et al. |
| 9,511,916 | B2 | 12/2016 | Holley, Jr. |
| 9,669,976 | B2 | 6/2017 | Kastanek et al. |
| 9,676,535 | B2 | 6/2017 | Spivey, Sr |
| 10,836,550 | B2 | 11/2020 | Zacherle |
| D920,809 | S | 6/2021 | Chesnet et al. |
| 11,027,905 | B2 | 6/2021 | Ford |
| 2002/0195371 | A1 | 12/2002 | Brown |
| 2003/0080004 | A1 | 5/2003 | Olsen et al. |
| 2003/0213705 | A1 | 11/2003 | Woog |
| 2004/0211695 | A1 | 10/2004 | Karlsson |
| 2004/0226833 | A1 | 11/2004 | Daniel |
| 2005/0127151 | A1 | 6/2005 | Johnson |
| 2005/0199513 | A1 | 9/2005 | Bakx et al. |
| 2009/0101526 | A1 | 4/2009 | Sutherland et al. |
| 2009/0127147 | A1 | 5/2009 | Sutherland |
| 2010/0078337 | A1 | 4/2010 | Sutherland et al. |
| 2010/0264043 | A1 | 10/2010 | DePaula |
| 2012/0138489 | A1 | 6/2012 | Holley, Jr. |
| 2015/0191287 | A1 | 7/2015 | L'Heureux et al. |
| 2016/0325899 | A1 | 11/2016 | L'Heureux et al. |
| 2018/0111734 | A1 | 4/2018 | Jego |
| 2018/0362234 | A1 | 12/2018 | L'Heureux et al. |
| 2019/0119019 | A1 | 4/2019 | Patton |
| 2020/0010255 | A1 | 1/2020 | Zacherle et al. |
| 2020/0189818 | A1 | 6/2020 | McCree |
| 2020/0189819 | A1 | 6/2020 | McCree |
| 2020/0189821 | A1 | 6/2020 | Smalley |
| 2020/0189822 | A1 | 6/2020 | Smalley |
| 2020/0223612 | A1 | 7/2020 | Swenson |
| 2021/0061502 | A1 | 3/2021 | Johnston |
| 2021/0094742 | A1 | 4/2021 | Gonzalez Manzano |
| 2021/0316921 | A1 | 10/2021 | Holtz |

FOREIGN PATENT DOCUMENTS

| | | | |
|---|---|---|---|
| DE | 298 13 672 | U1 | 11/1998 |
| DE | 10 2009 059 047 | A1 | 6/2011 |
| EP | 0 051 413 | A1 | 5/1982 |
| EP | 0 060 504 | A2 | 9/1982 |
| EP | 0 057 437 | B1 | 5/1985 |
| EP | 0 496 807 | | 6/1993 |
| EP | 0 636 096 | | 2/1995 |
| EP | 0 715 593 | A1 | 6/1996 |
| EP | 0 398 835 | B1 | 10/1996 |
| EP | 2 067 713 | A1 | 6/2009 |
| EP | 1 528 007 | B1 | 10/2010 |
| EP | 2739547 | B1 | 7/2017 |
| EP | 3 666 684 | A1 | 6/2020 |
| FR | 2 737 196 | A1 | 1/1997 |
| GB | 1 256 684 | | 12/1971 |
| GB | 2 321 229 | A | 7/1998 |
| JP | 10-297668 | A | 11/1998 |
| JP | 2001-519300 | A | 10/2001 |
| JP | 2003-146359 | | 5/2003 |
| JP | 2004-189243 | A | 7/2004 |
| JP | 2015-048088 | A | 3/2015 |
| KR | 10-2005-0051616 | A | 6/2005 |
| KR | 10-2020-0106806 | A | 9/2020 |
| WO | WO 93/02941 | | 2/1993 |
| WO | WO 93/21083 | | 10/1993 |
| WO | WO 93/25439 | A1 | 12/1993 |
| WO | WO 94/22738 | A1 | 10/1994 |
| WO | WO 95/01289 | A1 | 1/1995 |
| WO | WO 95/06604 | | 3/1995 |
| WO | WO 96/26128 | A1 | 8/1996 |
| WO | WO 96/32340 | A1 | 10/1996 |
| WO | WO 2008/058294 | A1 | 5/2008 |
| WO | WO 2010/006629 | A1 | 1/2010 |

OTHER PUBLICATIONS

European Search Report for EP 19 18 0446 dated Feb. 3, 2020.
European Search Report for EP 19 18 0453 dated Feb. 10, 2020.
International Search Report and Written Opinion for PCT/US2020/054205 dated Jan. 20, 2021.
International Search Report and Written Opinion for PCT/US2019/034491 dated Sep. 19, 2019.
International Search Report and Written Opinion for PCT/US2019/034490 dated Sep. 19, 2019.
International Search Report and Written Opinion for PCT/US2019/034494 dated Sep. 19, 2019.
International Search Report and Written Opinion for PCT/US2019/034489 dated Sep. 19, 2019.
International Search Report and Written Opinion for PCT/US2019/034493 dated Sep. 20, 2019.
International Search Report and Written Opinion for PCT/US2020/064472 dated Mar. 15, 2021.
International Search Report and Written Opinion for PCT/US2020/064471 dated Mar. 29, 2021.
International Search Report and Written Opinion for PCT/US2020/064473 dated Apr. 1, 2021.
European Search Report for EP 20 20 533 dated Mar. 23, 2021.
International Search Report and Written Opinion for PCT/US2020/024614 dated Sep. 15, 2020.
European Search Report for EP 20 16 8268 dated Oct. 2, 2020.
European Search Report for EP 19 18 0460 dated Jan. 13, 2020.
European Search Report for EP 19 18 0439 dated Jan. 10, 2020.
European Search Report for EP 20 21 5364 dated Jul. 1, 2021.
European Search Report for EP 20 21 5371 dated Jul. 1, 2021.
European Search Report for EP 20 21 5399 dated Jul. 1, 2021.
International Search Report and Written Opinion for PCT/US2021/052279 dated Jan. 5, 2022.
International Search Report and Written Opinion for PCT/US2021/052278 dated Jan. 5, 2022.
International Search Report and Written Opinion for PCT/US2021/052272 dated Jan. 7, 2022.

* cited by examiner

CARRIER FOR CONTAINERS

CROSS-REFERENCE TO RELATED APPLICATIONS

This application is a continuation-in-part of U.S. patent application Ser. No. 16/426,066, filed on May 30, 2019, which claims the benefit of each of U.S. Provisional Patent Application No. 62/779,689, filed on Dec. 14, 2018, U.S. Provisional Patent Application No. 62/783,752, filed on Dec. 21, 2018, U.S. Provisional Patent Application No. 62/796,830, filed on Jan. 25, 2019, U.S. Provisional Patent Application No. 62/797,585, filed on Jan. 28, 2019, U.S. Provisional Patent Application No. 62/810,015, filed on Feb. 25, 2019, U.S. Provisional Patent Application No. 62/814,412, filed on Mar. 6, 2019, U.S. Provisional Patent Application No. 62/817,120, filed on Mar. 12, 2019, and U.S. Provisional Patent Application No. 62/841,449, filed on May 1, 2019.

INCORPORATION BY REFERENCE

The disclosures of each of U.S. Provisional Patent Application No. 62/779,689, filed on Dec. 14, 2018, U.S. Provisional Patent Application No. 62/783,752, filed on Dec. 21, 2018, U.S. Provisional Patent Application No. 62/796,830, filed on Jan. 25, 2019, U.S. Provisional Patent Application No. 62/797,585, filed on Jan. 28, 2019, U.S. Provisional Patent Application No. 62/810,015, filed on Feb. 25, 2019, U.S. Provisional Patent Application No. 62/814,412, filed on Mar. 6, 2019, U.S. Provisional Patent Application No. 62/817,120, filed on Mar. 12, 2019, U.S. Provisional Patent Application No. 62/841,449, filed on May 1, 2019, U.S. patent application Ser. No. 16/426,050, filed on May 30, 2019, U.S. patent application Ser. No. 16/426,057, filed on May 30, 2019, U.S. patent application Ser. No. 16/426,060, filed on May 30, 2019, U.S. patent application Ser. No. 16/426,063, filed on May 30, 2019, U.S. patent application Ser. No. 16/426,066, filed on May 30, 2019, U.S. Design patent application No. 29/692,992, filed on May 30, 2019, U.S. Design patent application No. 29/692,993, filed on May 30, 2019, U.S. Design patent application No. 29/692,994, filed on May 30, 2019, U.S. Design patent application No. 29/692,996, filed on May 30, 2019, and U.S. Design patent application No. 29/692,997, are hereby incorporated by reference for all purposes as if presented herein in their entirety.

BACKGROUND OF THE DISCLOSURE

The present disclosure generally relates to cartons or carriers for holding, displaying, and/or transporting containers.

SUMMARY OF THE DISCLOSURE

According to one aspect of the disclosure, a carrier for holding a plurality of containers comprises a plurality of panels comprising a top panel, at least one central panel, and at least one attachment panel configured to receive a portion of one or more containers of the plurality of containers. The at least one central panel is for being positioned between and attached to adjacent containers of the plurality of containers. The carrier further comprises at least one access feature that is positionable for allowing access to at least one container of the plurality of containers, the at least one access feature comprises a marginal portion of the top panel and a marginal portion of the at least one attachment panel.

According to another aspect of the disclosure, a blank for forming a carrier for holding a plurality of containers comprises a plurality of panels comprising a top panel, at least one central panel, and at least one attachment panel, and at least one access feature comprising a marginal portion of the top panel and a marginal portion of the at least one attachment panel. The at least one access feature is for being positionable for allowing access to at least one container of the plurality of containers when the carrier is formed from the blank, and the at least one central panel is for being positioned between and attached to adjacent containers of the plurality of containers when the carrier formed from the blank.

According to another aspect of the disclosure, a method of forming a carrier for holding a plurality of containers, the method comprises obtaining a blank comprising a plurality of panels comprising a top panel, at least one central panel, and at least one attachment panel, and at least one access feature comprising a marginal portion of the top panel and a marginal portion of the at least one attachment panel. The method further comprises folding the plurality of panels such that the at least one central panel is positioned between adjacent containers of the plurality of containers, and attaching at least one container of the plurality of panels to the at least one central panel, the at least one access feature is positionable for allowing access to at least one container of the plurality of containers.

According to another aspect of the disclosure, a package comprises a plurality of containers and a carrier for holding the plurality of containers. The carrier comprises a plurality of panels comprising a top panel, at least one central panel, and at least one attachment panel receiving a portion of one or more containers of the plurality of containers, the at least one central panel is positioned between and attached to adjacent containers of the plurality of containers. The carrier further comprises at least one access feature that is positionable for allowing access to at least one container of the plurality of containers, the at least one access feature comprises a marginal portion of the top panel and a marginal portion of the at least one attachment panel.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Carriers according to the present disclosure can accommodate containers of numerous different shapes. For the purpose of illustration and not for the purpose of limiting the scope of the disclosure, the following detailed description describes beverage containers (e.g., aluminum cans) at least partially disposed within the carrier embodiments. In this specification, the terms "lower," "bottom," "upper," "top," "front," and "back" indicate orientations determined in relation to fully erected carriers.

As described herein, carriers may be formed by multiple overlapping panels, end flaps, and/or other portions of blanks. Such panels, end flaps, and/or other portions of the blank can be designated in relative terms to one another, e.g., "first", "second", "third", etc., in sequential or non-sequential reference, without departing from the disclosure.

Figure 1:
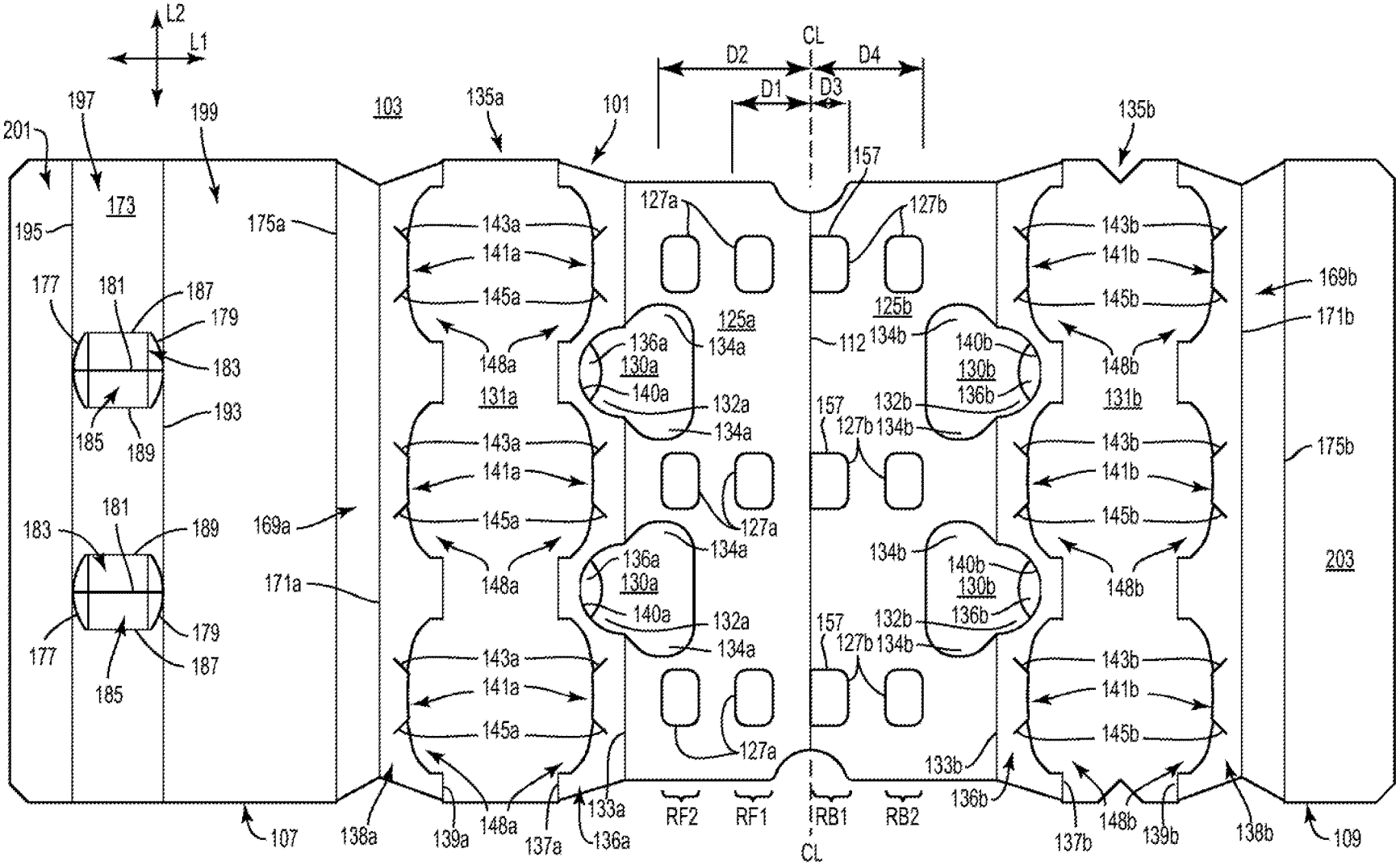
FIG. 1 is a plan view of an outer surface of a blank for forming a carrier and package according to a first exemplary embodiment of the disclosure.
Figure 7:
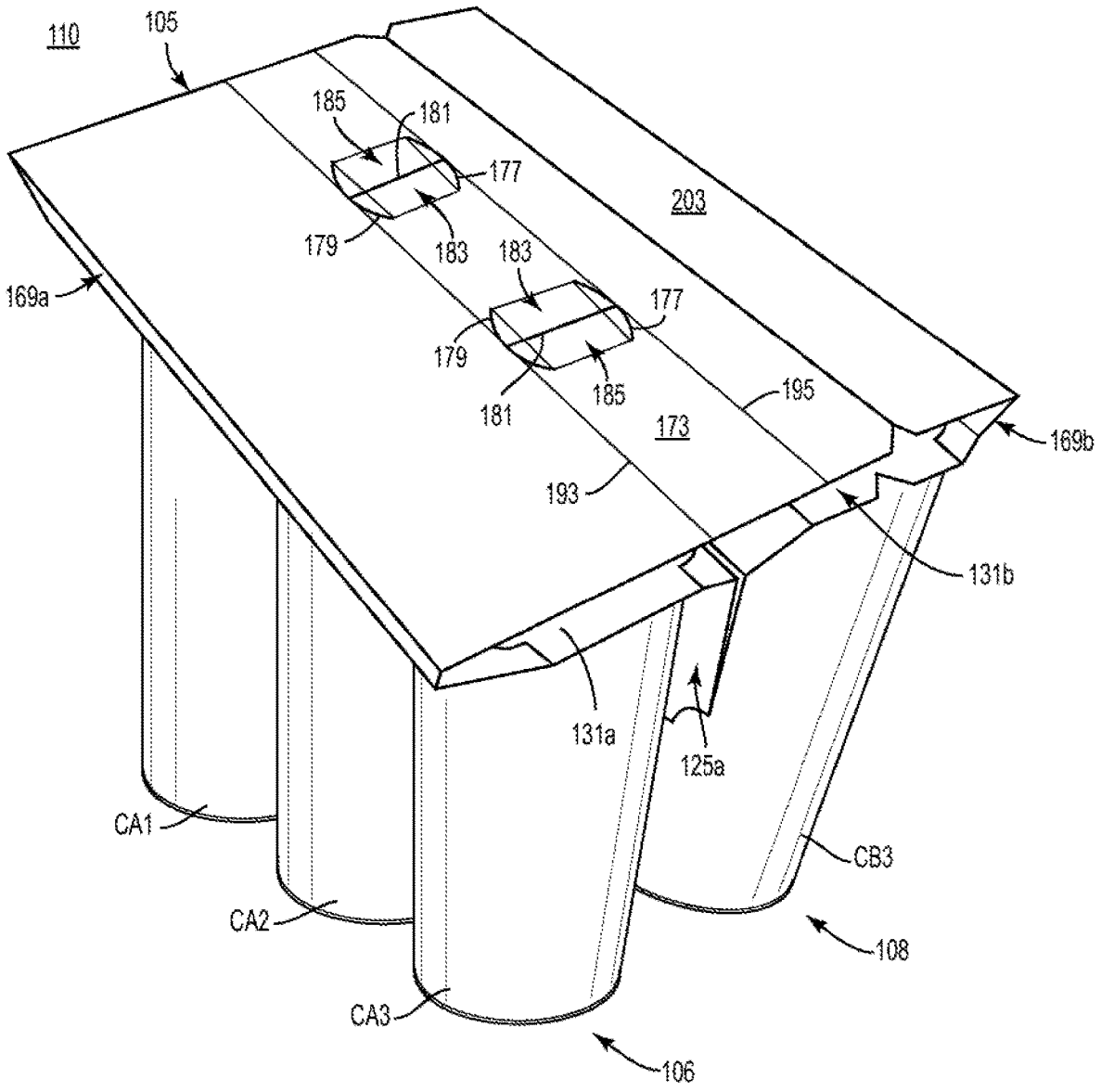
FIG. 7 is a perspective view of a package and carrier formed from the blank of FIG. 1 according to the first exemplary embodiment and having access features in a first configuration.

FIG. 1 shows a plan view of an exterior side 101 of a blank 103 used to form a carrier 105 (FIG. 7) in accordance with a first exemplary embodiment of the disclosure. The carrier 105 can be sized to contain or support six containers, with three containers CA1, CA2, CA3 being attached to a front portion 106 of the carrier 105 and three containers CB1, CB2, CB3 being attached to a back portion 108 of the carrier 105. In the illustrated embodiment, the containers CA1, CA2, CA3, CB1, CB2, CB3 can be beverage cans, or could be any other suitable type and size of container without departing from the disclosure. The carrier 105 can be sized and shaped to hold more or less than six containers. In one embodiment, the front portion 106 and the back portion 108 of the carrier 105 each have three containers, and in other embodiments, the front portion 106 and the back portion 108 of the carrier 105 can carry more or less than three containers without departing from the disclosure. The carrier 105 can be provided together with one or more containers as a package 110 (FIG. 7).

As shown in FIG. 1, the blank 103 has a longitudinal axis L1 and a lateral axis L2. The blank 103 has a front portion 107 for forming the front portion 106 of the carrier 105, and a back portion 109 for forming the back portion 108 of the carrier 105. The front portion 107 and the back portion 109 of the blank 103 are foldably connected at a lateral fold line 112 that forms a lateral centerline CL of the blank 103, as shown. As discussed further below, the blank 103 is at least partially formed into the carrier 105 by folding the blank 103 at the fold line 112 along the centerline CL so that the front portion 107 and the back portion 109 of the blank 103 are overlapped in at least partial face-to-face contact.

In the illustrated embodiment, the front portion 107 of the blank 103 comprises a front central panel 125*a* having a first front row RF1 of laterally spaced adhesive or glue openings 127*a*, and a second front row RF2 of the laterally spaced adhesive or glue openings 127*a*. The top edges of the respective glue openings 127*a* of the first row RF1 are spaced a longitudinal distance D1 apart from the fold line 112 that is less than a longitudinal distance D2 that the top edges of the respective glue openings 127*a* of the second row RF2 are spaced apart from the fold line 112.

A front container retention panel or front attachment panel 131*a* is foldably connected to the front central panel 125*a* at a lateral fold line 133*a*, and includes a container retention portion 135*a* that is at least partially defined between a pair of longitudinally-spaced lateral fold lines 137*a*, 139*a* (broadly, respective "second fold line") that are each interrupted by respective pairs of longitudinally-spaced cuts 141*a* that can each include one or more curved and/or angled portions. As shown, the longitudinally-spaced cuts 141*a* define container retention tabs 148*a* that extend outwardly from the container retention portion 135*a*. As also shown, respective oblique cuts 143*a*, 145*a* extend outwardly from each respective cut 141*a* to define a plurality of reconfigurable edges of the front attachment panel 131*a* that face the respective container retention tabs 148*a*.

As shown, an interior marginal portion 136*a* of the attachment panel 131*a* is defined between the fold lines 137*a*, 133*a*, and an exterior marginal portion 138*a* of the attachment panel 131*a* is defined between the fold line 139*a* and a lateral fold line 171*a*.

The blank 103 can include a pair of handle openings 130*a* that interrupt the fold line 133*a* and that extend from a portion of the front central panel 125*a* into a portion of the front attachment panel 131*a*. As shown, the handle openings 130*a* can include a longitudinal section 132*a* extending parallel to the longitudinal axis L1 and a pair of lateral sections 134*a* that intersect and diverge orthogonally away from the longitudinal section 132*a* in substantial parallel relation with the lateral axis L2. In this regard, the divergent sections 132*a*, 134*a* of the handle opening 130*a* are in communication with one another. As described further herein, the sections 132*a*, 134*a* of the handle opening 130*a* provide multiple engagement surfaces at which a consumer can grasp the carrier 105, in different orientations. As also shown, a reinforcement flap 136*a* is foldably connected to the respective attachment panel 131*a* at a respective curved fold line 140*a*, and extends into the respective longitudinal section 132*a*. The carrier 105 can have a different arrangement of handle features, or can be devoid of handle features, without departing from the disclosure.

The blank 103 additionally includes a bevel or front side panel 169*a* that is foldably connected to the front attachment panel 131*a* at the lateral fold line 171*a*, and a top panel 173 that is foldably connected to the front side panel 169*a* at a lateral fold line 175*a*. The top panel 173, as shown, includes additional handle features (broadly, "first handle feature" and "second handle feature") that each include a pair of opposed curved cuts 177, 179 and a longitudinal cut 181 extending from the curved cut 177 to the curved cut 179 to define a pair of handle flaps 183, 185. A pair of longitudinal lines of weakening 187, 189 and a pair of lateral lines of weakening 190, 191 extend along a portion of each flap 183, 185 so as to provide an at least partially reconfigurable arrangement, as described further herein. In one embodiment, one or more of the lines of weakening 187, 189, 190, 191 can be a surface feature such as an emboss or deboss feature. Handle features of the carrier 205 include the handle features in the top panel 173, and can also include the handle openings 130*a*, 130*b*. The carrier 105 can have a different arrangement of handle features, or can be devoid of handle features, without departing from the disclosure.

Still referring to FIG. 1, the top panel 173 additionally includes a pair of laterally-spaced longitudinal fold lines 193, 195 (broadly, "first fold line" and "second fold line", respectively) that define a central portion 197 therebetween, and which further define a first marginal portion 199 of the top panel 173 defined between the fold lines 175*a*, 193, and a second marginal portion 201 of the top panel 173 defined between the fold line 195 and a lateral free edge of the top panel 173. In this regard, the first marginal portion 199 of the top panel 173 is defined between the fold line 193 and the front side panel 169*a*.

As described further herein, upon formation of the carrier 105, the central portion 197 of the top panel 173 is positioned to generally overlap and align with respective portions of the container retention portion 135*a* of the front attachment panel 131*a* and a container retention portion 135*b* of a back attachment panel 131*b*, the first marginal portion 199 of the top panel 173 is positioned to generally align with an exterior marginal portion 138*b* of the back attachment panel 131*b*, and the second marginal portion 201 of the top panel 173 is positioned to generally align with the exterior marginal portion 138*a* of the front attachment panel 131*a*.

In the illustrated embodiment, the back portion 109 of the blank 103 includes a back central panel 125*b* and the back container retention panel or back attachment panel 131*b* having associated features that are generally a mirror-image of the corresponding panels and flaps of the front portion 107 of the blank 103. Corresponding components (e.g., panels, flaps, fold lines, cuts, etc.) have been designated by corresponding reference numbers that differ by the "a" or "b" suffix, with the "a" components corresponding to the front portion 107 of the blank 103 and the "b" components corresponding to the back portion 109 of the blank 103. The back portion 109 of the blank 103 additionally includes a back side panel 169*b* foldably connected to the back attachment panel 131*b* at a lateral fold line 171*b*, and an attachment flap 203 foldably connected to the back side panel 169*b* at a lateral fold line 175*b*.

As shown, a pair of generally U-shaped cuts 157 extend from the centerline CL and have a respective lateral portion that defines the top edge of respective glue openings 127*b* of a first back lateral row RB1 of laterally spaced glue openings 127*b*. As shown, the top edges of the respective glue openings 127*b* of the first lateral row RB1 of glue openings 127*b* are spaced a longitudinal distance D3 apart from the fold line 112 that is less than a longitudinal distance D4 that the top edges of respective glue openings 127*b* of a second back lateral row RB2 of glue openings 127*b* are spaced apart from the fold line 112.

In this regard, the blank 103 is provided with front rows RF1 and RF2 of laterally-spaced front glue openings 127*a* that are spaced respective longitudinal distances D1, D2 from the centerline CL, and back rows RB1 and RB2 of laterally-spaced back glue openings 127*b* that are spaced respective longitudinal distances D3, D4 from the centerline CL. The glue openings 127*a*, 127*b* have a longitudinally staggered arrangement such that D2>D4>D1>D3. Upon formation of the carrier 105 from the blank 103, the longitudinal centerline CL/fold line 112 can form a bottom edge of the central panels 125*a*, 125*b*.

As described herein, the arrangement of the glue openings 127*a*, 127*b* is such that, upon erection of the carrier 105, the glue openings 127*a*, 127*b* provide access to a respective plurality of surfaces of the respective central panels 125*b*, 125*a* upon which the respective containers CA1, CA2, CA3, CB1, CB2, CB3 can be attached to enhance retention and support of the containers CA1, CA2, CA3, CB1, CB2, CB3 by the carrier 105.

Any of the panels, flaps, fold lines, cuts, or other features could be otherwise shaped, arranged, and/or omitted from the blank 103 without departing from the disclosure. The blank 103 could be sized and/or shaped to accommodate more or less than four containers without departing from this disclosure.

Figure 2:
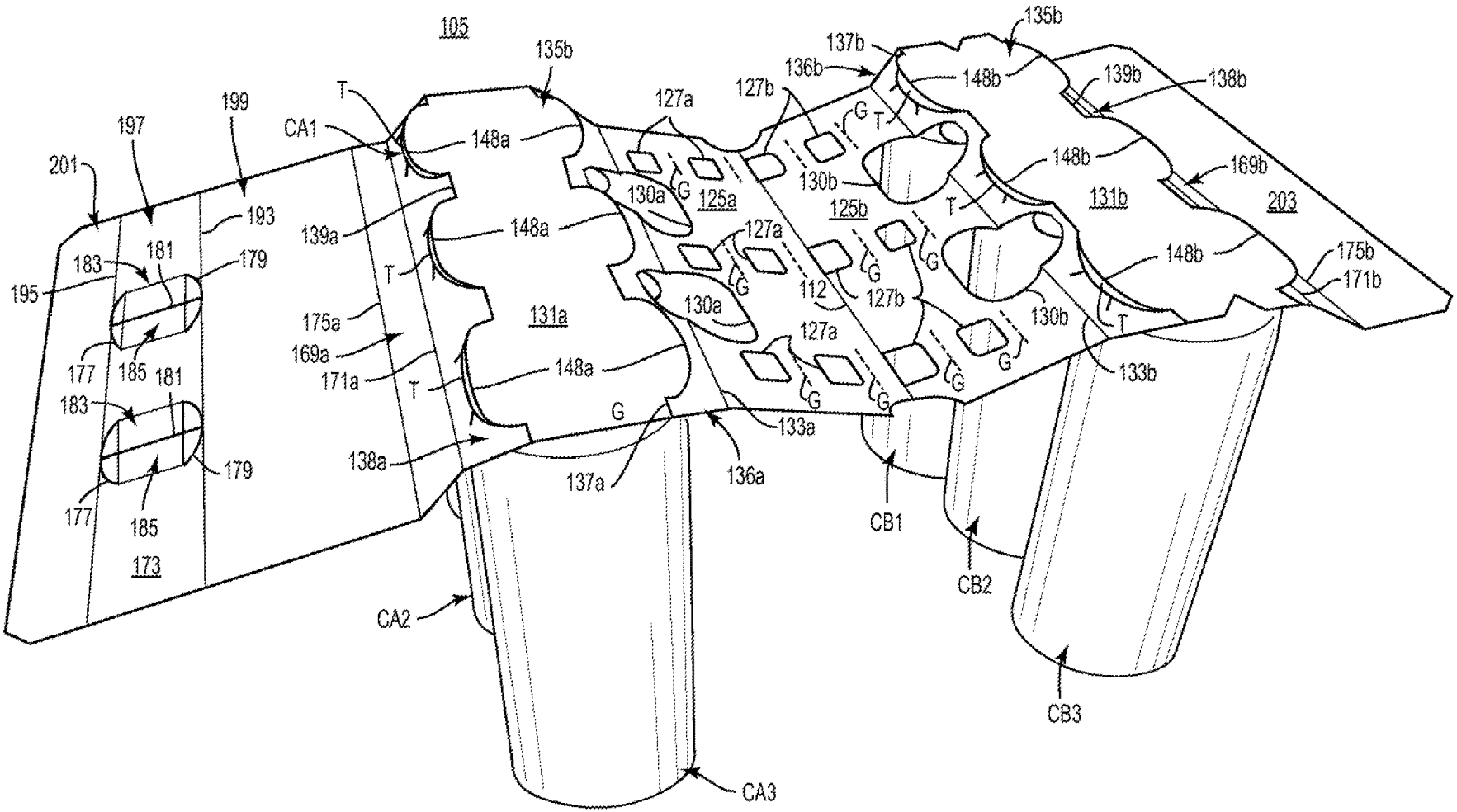
FIG. 2 is a perspective view of a partially folded configuration of a carrier formed from the blank of FIG. 1 according to the first exemplary embodiment.

As shown in FIG. 2, an interior surface or underside of the blank 103 can be placed atop the containers CA1, CA2, CA3, CB1, CB2, CB3 such that the container retention portion 135*a* of the front attachment panel 131*a* overlies the containers CA1, CA2, CA3 and such that the container retention portion 135*b* of the back attachment panel 131*b* overlies the containers CB1, CB2, CB3. Further downward positioning of the attachment panels 131*a*, 131*b* over the plurality of containers CA1, CA2, CA3, CB1, CB2, CB3 can activate the respective container retention portions 135*a*, 135*b* to engage respective containers. For example, as the front attachment panel 131*a* is lowered or urged downwardly onto the containers CA1, CA2, CA3, the container retention portion 135*a* can at least partially separate from the remainder of the front attachment panel 131*a* at the cuts 141*a*. In such an arrangement, upper or top portions T of the respective containers CA1, CA2, CA3 can extend at least partially through respective openings formed by the respective cuts 141*a* such that the container retention tabs 148*a* can engage, for example, a recessed portion of a rim or other top structure of the respective container CA1, CA2, CA3, and such that a plurality of reconfigurable edges of the marginal portions 136*a*, 138*a* can engage, for example, a rolled rim edge or other top structure of the respective container CA1, CA2, CA3.

Such reconfiguration of the corresponding portions of the back attachment panel 131*b* can occur as the back attachment panel 131*b* is lowed or urged downwardly onto the containers CB1, CB2, CB3. During the above-described engagement of the respective container retention portions 135*a*, 135*b* with the respective containers, the marginal portions 136*a*, 138*a* of the attachment panel 131*a* can fold at least partially downwardly at the respective fold lines 137*a*, 139*a* in such a configuration, and, similarly, the marginal portions 136*b*, 138*b* of the attachment panel 131*b* can fold at least partially downwardly at the respective fold lines 137*b*, 139*b*.

Figure 3:
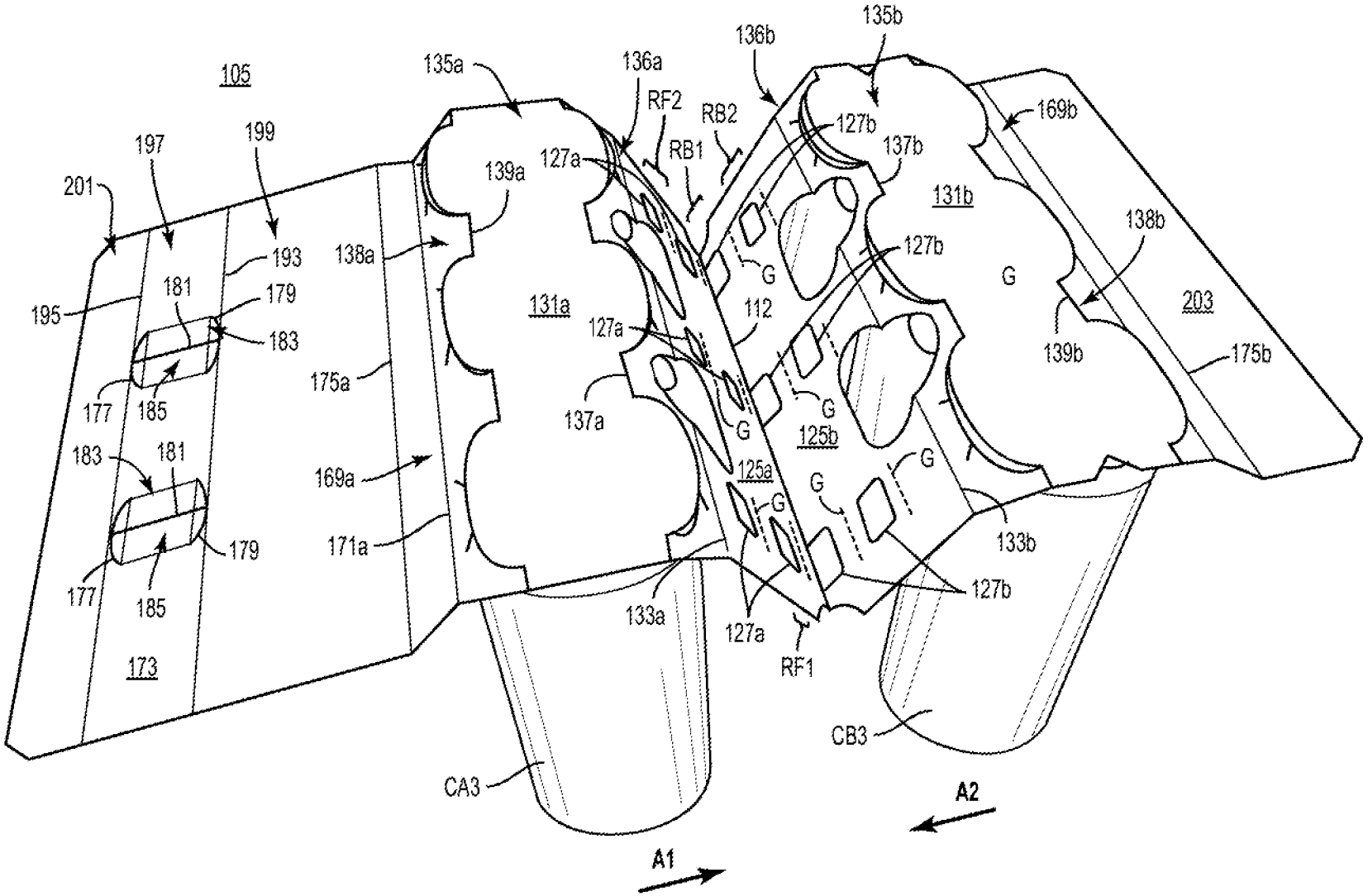
FIG. 3 is a perspective view of another partially folded configuration of a carrier formed from the blank of FIG. 1 according to the first exemplary embodiment.

Referring additionally to FIG. 3, the front central panel 125*a* and the back central panel 125*b* can be folded at the fold line 112 such that the front central panel 125*a* and the back central panel 125*b* are brought into at least partial face-to-face contact in the direction of the arrows A1, A2 to be positioned between respective adjacent containers and such that the respective glue openings 127*a*, 127*b* are positioned so as to be laterally aligned but longitudinally offset due to the different relative spacing of the respective rows RF1, RF2 of the front glue openings 127*a* and the respective rows RB1, RB2 of the back glue openings 127*b* away from the fold line 112 as described above.

In this regard, the central panels 125*a*, 125*b* are arranged such that a portion of the front central panel 125*a* overlaps each of the glue openings 127*b* and a portion of the back central panel 125*b* overlaps each of the glue openings 127*a* to provide communication between the central panels 125*a*, 125*b* and respective surfaces upon which the respective containers CA1, CA2, CA3, CB1, CB2, CB3 can be adhered or otherwise attached, as described further herein. Such rearrangement of the central panels 125*a*, 125*b* can also cause the respective central panels 125*a*, 125*b* to be folded downwardly relative to the respective attachment panels 131*a*, 131*b* at the respective fold lines 133*a*, 133*b*.

Figure 4:
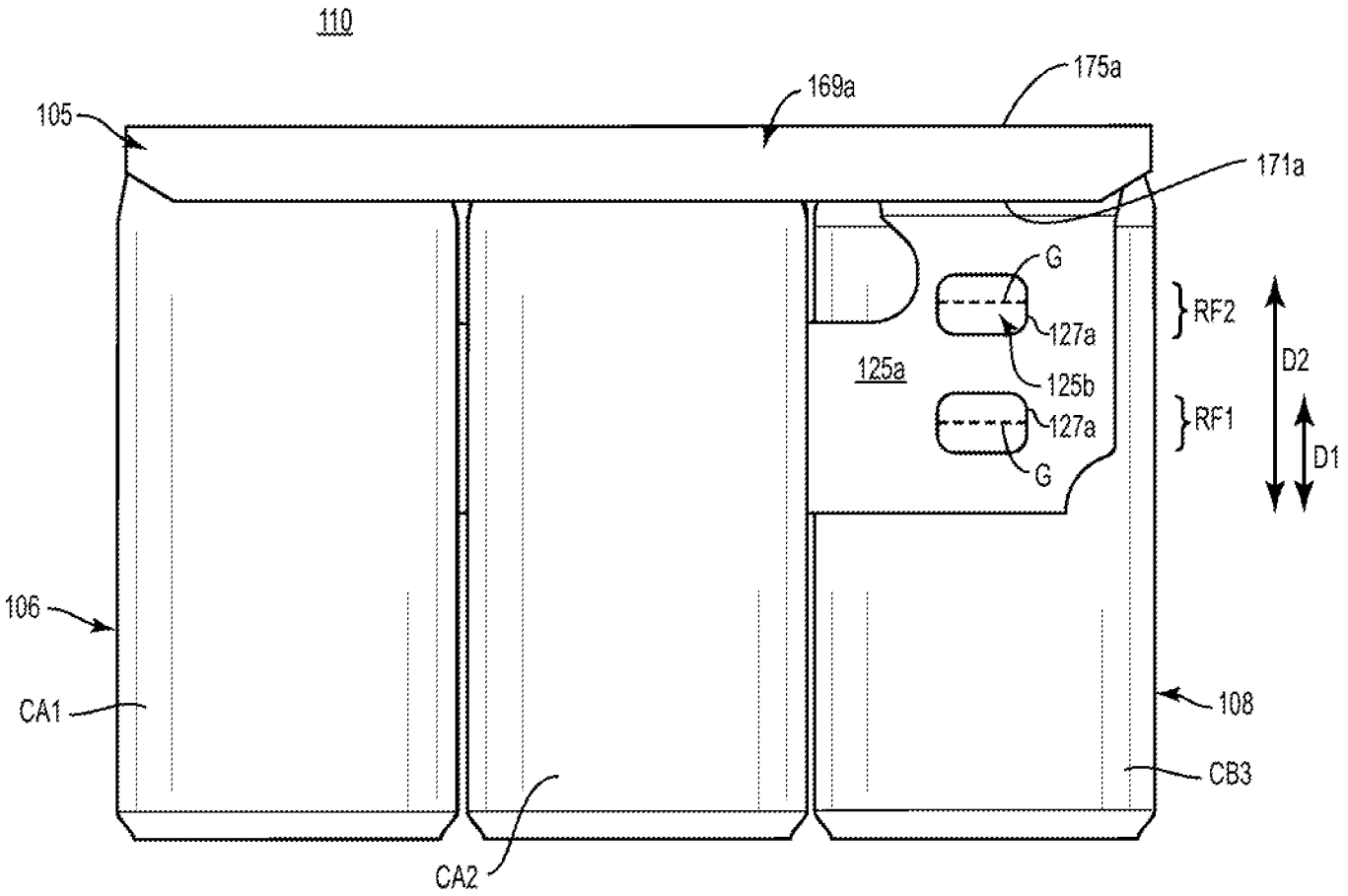
FIG. 4 is a front view of a carrier formed from the blank of FIG. 1 according to the first exemplary embodiment and having a container removed therefrom.
Figure 5:
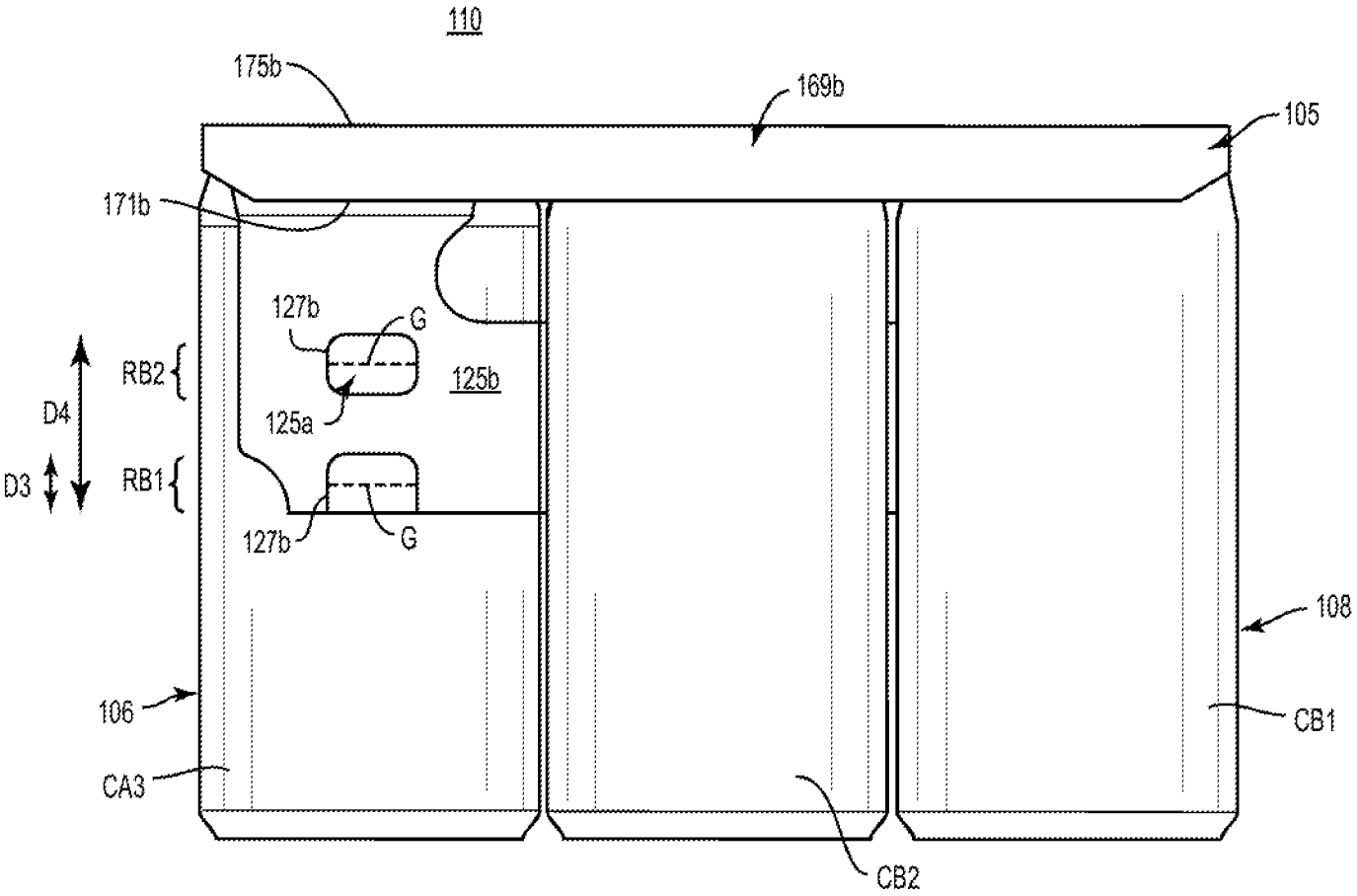
FIG. 5 is a rear view of the carrier of FIG. 4 and having a container removed therefrom.

Referring to FIGS. 4 and 5, in which the respective containers CA3, CB1 are removed for clarity of illustration, an adhesive glue G can be provided to adhere the containers CA1, CA2, CA3 to respective portions of the central panel 125*b* exposed through the respective glue openings 127*a*, and the glue G can be provided to adhere the containers CB1, CB2, CB3 to respective portions of the central panel 125*a* exposed through the respective glue openings 127*b*. The arrangement of multiple rows of respective glue openings 127*a*, 127*b* provides multiple points of attachment of each respective container to the respective opposite central panel 125*a*, 125*b* such that each container is provided with a robust attachment to a respective central panel 125*a*, 125*b*. The attachment of the containers CA1, CA2, CA3, and containers CB1, CB2, CB3 to the respective central panel 125*a*, 125*b* can provide retention and support of the respective containers, e.g., such that the containers do not detach from the carrier 105 under their own weight, in addition to or alternative to the container retention and support provided by the respective container retention portions 135*a*, 135*b*. For example, in one embodiment, one or more of the containers CA1, CA2, CA3, CB1, CB2, CB3 can be attached to a respective central panel 125*a*, 125*b* with glue G, without additional retention and support provided by a container retention portion as described above.

The glue G described herein can be, for example, a hot melt adhesive, a high tack glue, an epoxy, a polymeric cement, etc., or combinations thereof. The glue G can have a different arrangement without departing from the disclosure. For example, in one embodiment, the glue G can be applied to one or more portions of the exterior surface of the blank 103/carrier 105.

Such enhanced attachment of the respective containers to the respective central panels 125*a*, 125*b* with the glue G can also provide enhanced integrity to the carrier 105, e.g., by providing opposing adhesive forces on the respective central panels 125*a*, 125*b* such that the central panels 125*a*, 125*b* are compressed therebetween. For example, in one embodiment, as the carrier 105 is lifted, the containers CA1, CA2, CA3 can at least partially pull the portions of the back central panel 125*b* to which they are attached through the respective glue openings 127*a* toward the front central panel 125*a* under the at least partial weight of the containers CA1, CA2, CA3. Respective portions of the front central panel 125*a* can be pulled toward the back central panel 125*b* through the respective glue openings 127*b* by the containers CB1, CB2, CB3 in a similar manner.

Figure 6:
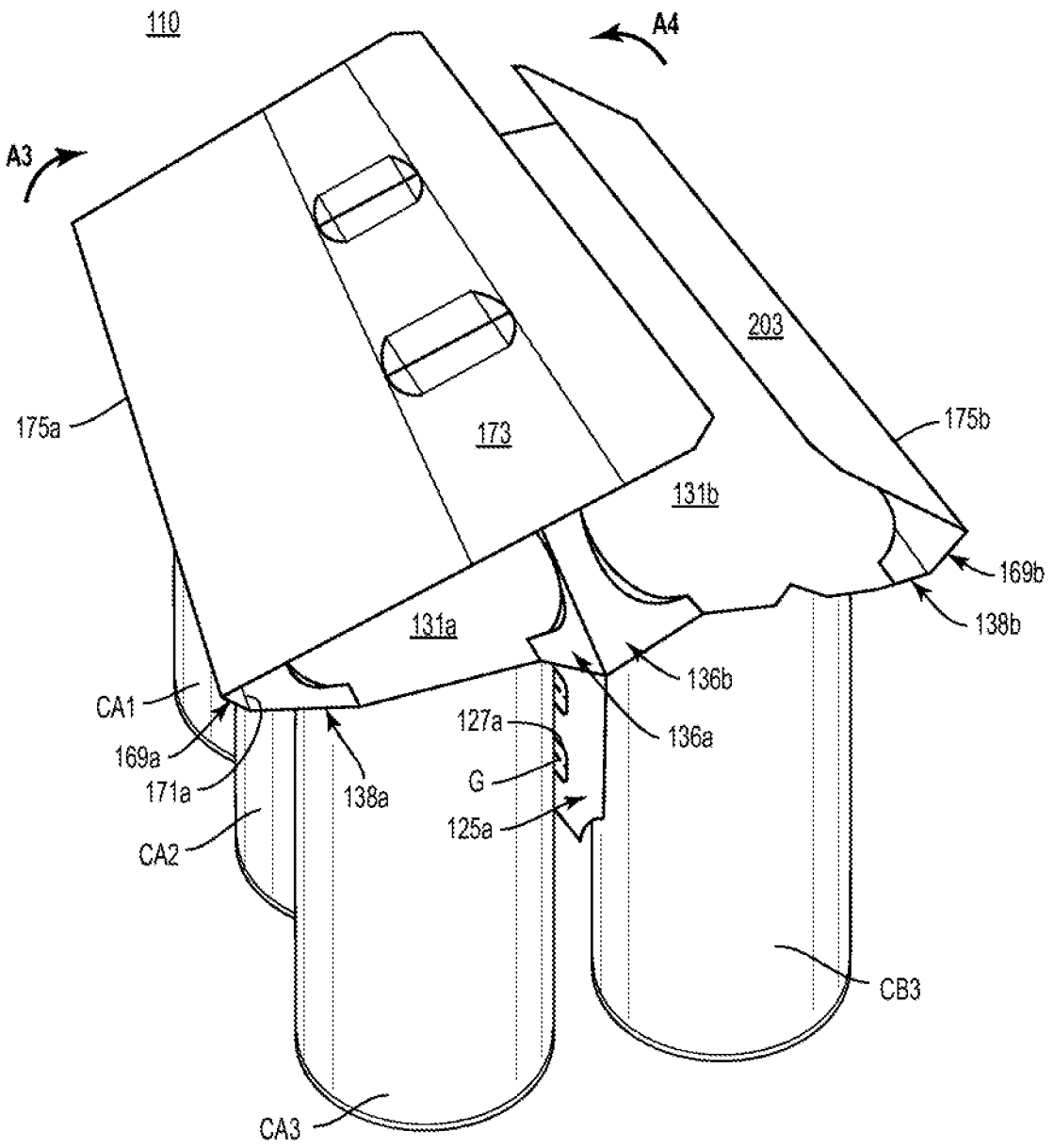
FIG. 6 is a perspective view of another partially folded carrier formed from the blank of FIG. 1 according to the first exemplary embodiment.

Referring to FIGS. 6 and 7, the front side panel 169*a* can be folded upwardly at the fold line 171*a*, for example, to be at an oblique arrangement relative to the containers CA1, CA2, CB1, CB2, CB3 and the top panel 173 can be folded at the fold line 175*a* generally in the direction of the arrow A3 into at least partial face-to-face contact with at least a portion of the attachment panels 131*a*, 131*b*. Similarly, the back side panel 169*b* can be folded upwardly at the fold line 171*b* into an oblique arrangement with the containers CA1, CA2, CA3, CB1, CB2, CB3 and the attachment flap 203 can be folded at the fold line 175*b* generally in the direction of the arrow A4 into at least partial face-to-face contact with the top panel 173 and/or the attachment panel 131*b*. Such an arrangement can be maintained with an adhesive such as glue.

The respective handle flaps 183, 185 can be at least partially separated from the top panel 173 at the respective cuts 177, 179, and from each other at the respective cuts 181, and folded or flexed downwardly into an interior portion of the carrier 105/package 110. The handle openings 130*a*, 130*b* provide clearance for the handle flaps 183, 185 to extend downwardly in such an arrangement. In one embodiment, one or both of the handle flaps 183, 185 can be provided with a reconfigurable arrangement, for example, so as to contour or angle against one or more of the respective containers CA1, CA2, CA3, CB1, CB2, CB3, e.g., such that at least a central portion of the respective handle flaps 183, 185 can be positioned between adjacent containers.

In one embodiment, marginal portions of the respective handle flaps 183, 185 can at least partially wrap around or surround a consumer's finger, for example, to minimize or prevent contact of the consumer's finger with edges or corners of the carrier 105/package 110 and/or the respective containers. In addition, and as described above, the divergent nature of the respective longitudinal sections 132*a*, 132*b* and the respective lateral sections 134*a*, 134*b* of the respective handle openings 130*a*, 130*b* allows a consumer multiple edges and surfaces by which to engage and lift the carrier 105 such that the consumer can engage the carrier from multiple orientations, e.g., a lateral orientation or a longitudinal orientation, or orientations therebetween.

Should the handle openings 130*a*, 130*b* be engaged at the edges of the respective longitudinal sections 132*a*, 132*b*, the respective reinforcement flaps 136*a*, 136*b* can at least partially fold downwardly at the respective curved fold lines 138*a*, 138*b* to provide additional reinforcing structure between a customer's fingers and the respective attachment panel 131*a*, 131*b*, e.g., in a three-ply configuration.

Figure 8:
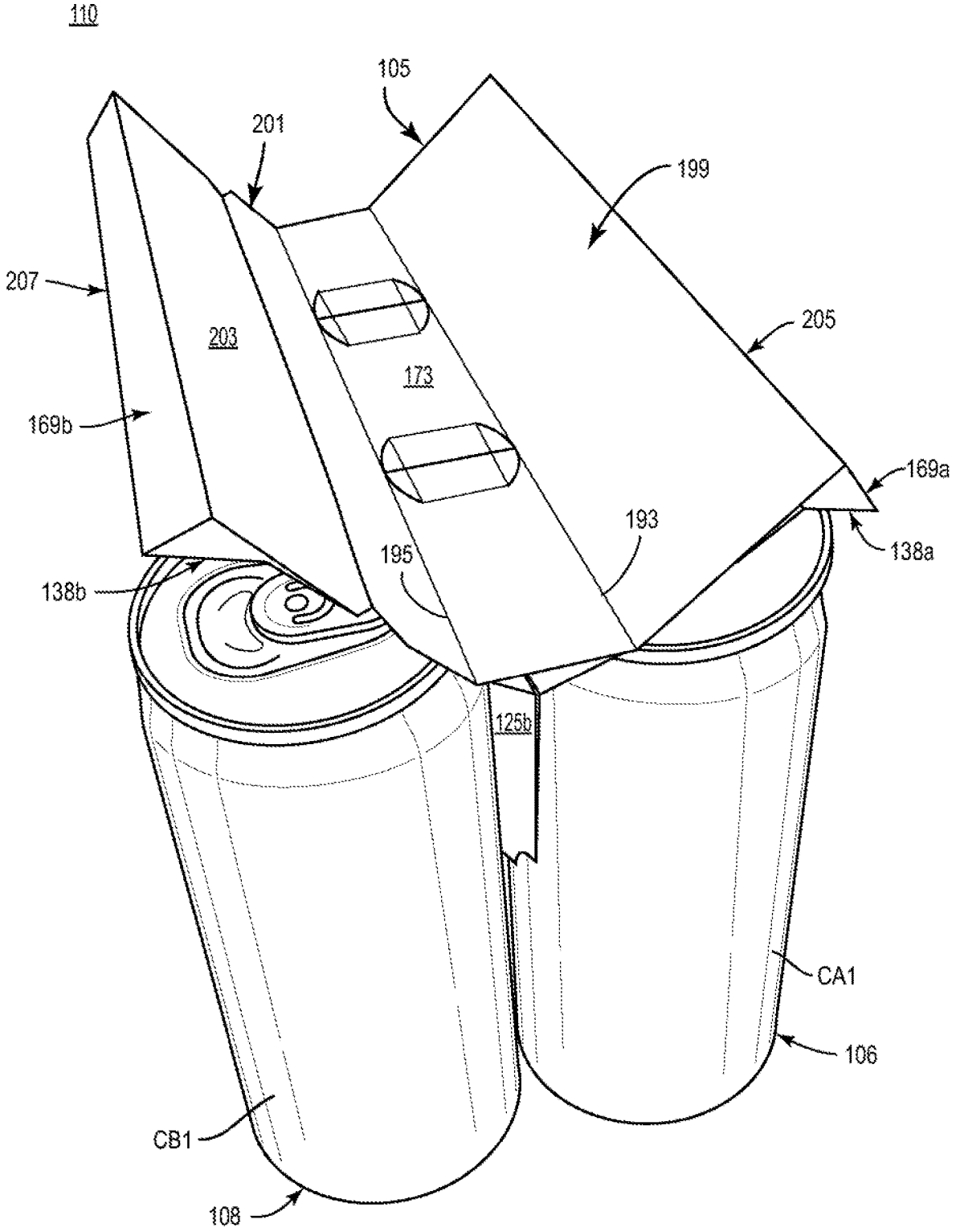
FIG. 8 is a perspective view of the package and carrier of FIG. 7, having access features in a second configuration.
Figure 9:
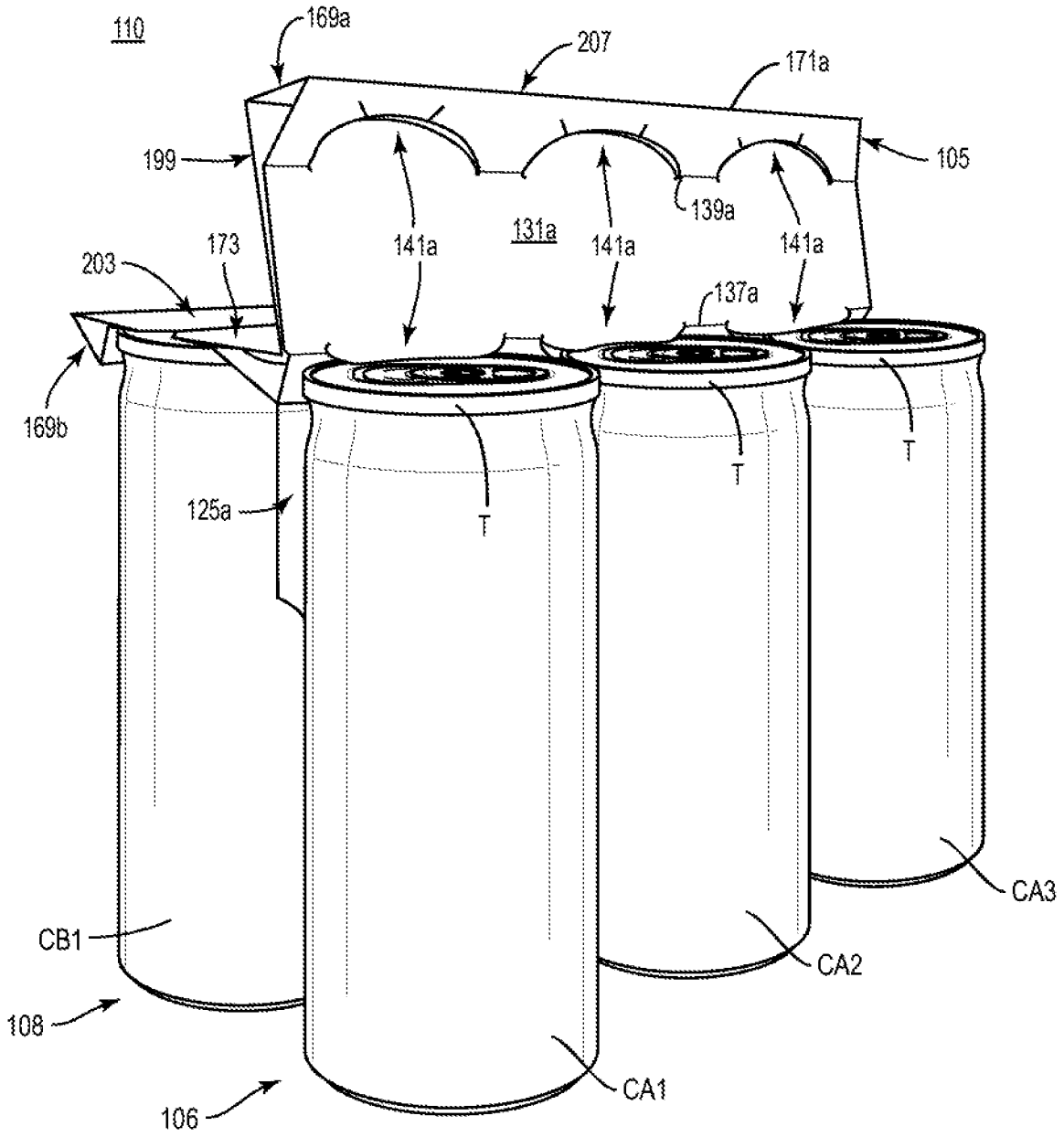
FIG. 9 is another perspective view of the package and carrier of FIG. 7, having one access feature in a second configuration.
Figure 10:
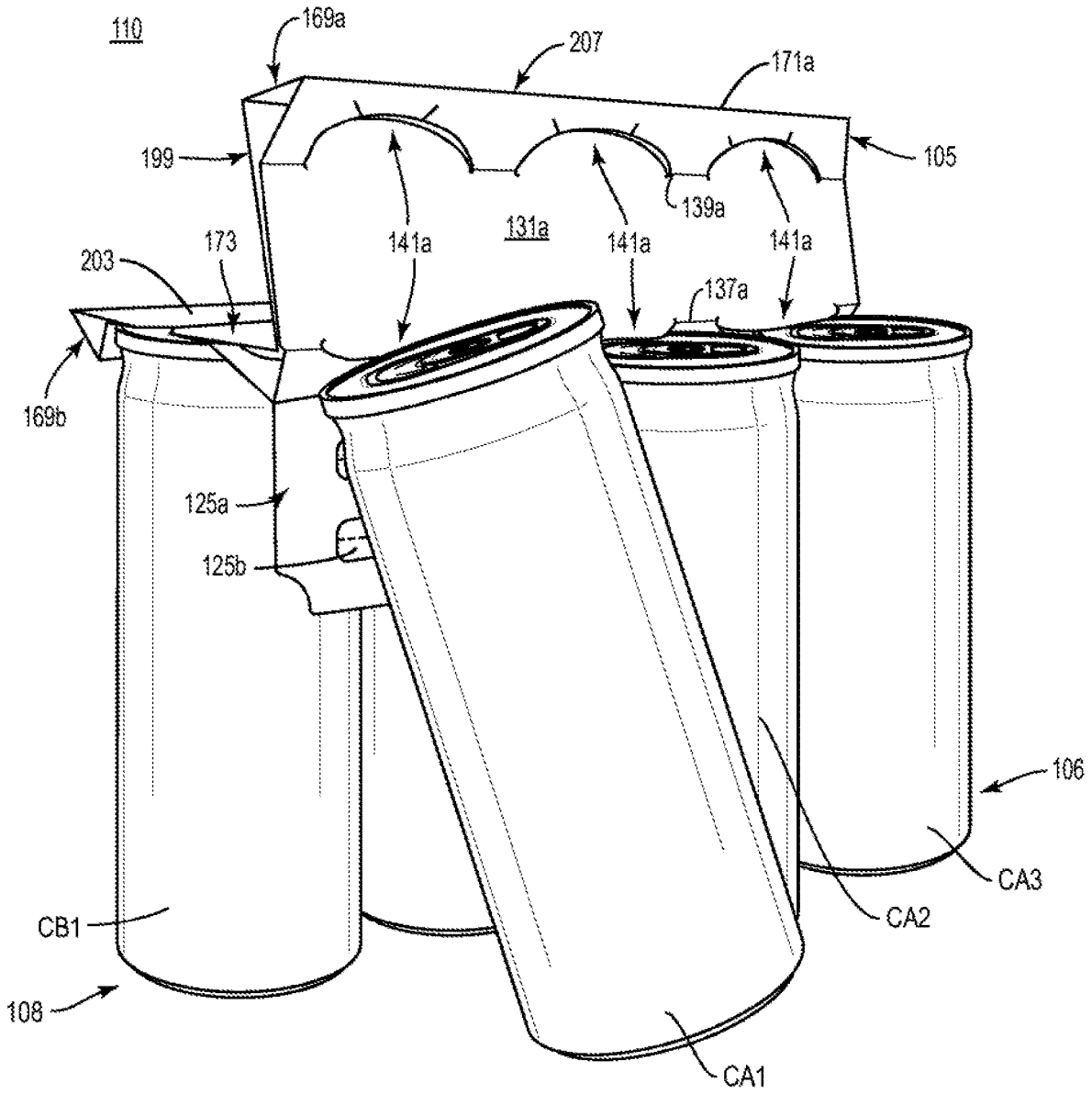
FIG. 10 is a perspective view of the package and carrier of FIG. 9 and having a container removed therefrom.

Referring additionally to FIGS. 8-10, an at least partial reconfiguration of the carrier 105 to facilitate removal of one or more of the containers CA1, CA2, CA3, CB1, CB2, CB3 will be described in accordance with an exemplary embodiment of the disclosure.

As shown in FIGS. 7 and 8, one or both of the first marginal portion 199 and the second marginal portion 201 of the top panel 173 can be folded at least partially upwardly at the respective fold lines 193, 195. Upward movement of the first marginal portion 199 can carry the front panel 169*a* and the exterior marginal portion 138*a* of the front attachment panel 131*a* therewith such that the first marginal portion 199, the front panel 169*a*, and the exterior marginal portion 138*a* can together form an articulable access feature 205 (broadly, "first access feature") that provides at least partial access to the containers CA1, CA2, CA3 in the front portion 106 of the carrier 105. Similarly, the second marginal portion 201 of the top panel 173, the attachment flap 203 underlapped on the marginal portion 201, the back panel 169*b*, and the exterior marginal portion 138*a* can together form an articulable access feature 207 (broadly, "second access feature") that provides at least partial access to the containers CB1, CB2, CB3 in the back portion 108 of the carrier 105.

For example, the access feature 205 can be grasped by a customer, for example, by curling his or her fingers around portions of the first marginal portion 199 of the top panel 173, the front panel 169*a*, and/or the exterior marginal portion 138*a* of the attachment panel 131*a*, and lifting upwardly such that these panels/portions articulate to fold at least partially at the aligned fold lines 193, 139*a* in the respective top panel 173 and attachment panel 131*a*. In one embodiment, the fold lines 193, 139*a* can be positioned in an offset relationship.

Such movement of the access feature 205 can cause at least partial disengagement of one or more of the containers CA1, CA2, CA3 from the attachment panel 131*a*, for example, by withdrawing the top portion T of a respective container through an opening formed by a respective cut 141*a* along the respective attachment panel 131*a*.

Similarly, the access feature 207 can be grasped by a customer by curling his or her fingers around portions of the second marginal portion 201 of the top panel 173, the back panel 169*b*, and/or the exterior marginal portion 138*a* and lifting upwardly at the aligned fold lines 195, 139*b* in the respective top panel 173 and attachment panel 131*a* to provide access to the containers CB1, CB2, CB3 in the back portion 108 of the carrier 105. Such movement of the access feature 207 can cause at least partial disengagement of one or more of the containers CB1, CB2, CB3 from the attachment panel 131*b* as described above with respect to the containers CA1, CA2, CA3. In one embodiment, the fold lines 195, 139*b* can be positioned in an offset relationship.

Accordingly, the access features 205, 207 are each reconfigurable/positionable between a first configuration/position, in which one or both of the marginal portions 199, 201 of the top panel 173 are generally perpendicular to the central panels 125*a*, 125*b*, and a second configuration/position, in which one or both of the marginal portions 199, 201 of the top panel 173 are generally raised or upright relative to the central panels 125*a*, 125*b*, e.g., such that the marginal portions 199, 201 are parallel with or obliquely-disposed relative to the central panels 125*a*, 125*b*, for example, to allow access to the containers. In the second configuration of the access features 205, 207, at least the respective marginal portions 138*a*, 138*b* of the respective attachment panels 135*a*, 135*b* can also be generally raised or upright relative to the central panels 125*a*, 125*b*.

In one embodiment, the respective marginal portions 138*a*, 138*b* of the respective attachment panels 135*a*, 135*b* can be considered to be generally perpendicular to the central panels 125*a*, 125*b* when the access features 205, 207 are in the first configuration/position.

It will be understood that the access features 205, 207 can each be reconfigured/positioned from the second configuration/position by reversing the movement of the access features 205, 207 described above. For example, the access features 205, 207 can be folded at least partially downwardly at the respective fold lines 193, 139*a* and fold lines 195, 139*b* toward a generally perpendicular arrangement relative to the central panels 125*a*, 125*b*. Such movement of the access features 205, 207 can cause at least partial re-engagement of one or more of the containers CA1, CA2, CA3 and CB1, CB2, CB3 with the respective attachment panels 131*a*, 131*b* as described above.

As shown in FIGS. 9 and 10, in which only the second access feature 207 is shown in the second configuration/position, a respective container CA1, CA2, CA3, CB1, CB2, CB3 can be further removed from the carrier 105 by peeling the respective container away from the respective central panel 125*a*, 125*b*. Peeling or pulling the containers CA1, CA2, CA3, CB1, CB2, CB3 away from a respective central panel 125*a*, 125*b* can involve pulling the respective container with a force sufficient to overcome the adhesive bond of the respective container and the respective central panel 125*a*, 125*b* provided by the glue G. In one embodiment, the glue G can be selected so as to remain on a respective central panel 125*a*, 125*b*, e.g., such that substantially little or no glue G remains on the container as it is removed.

One or more of the containers CA1, CA2, CA3, CB1, CB2, CB3 in one embodiment, can be reattached to a respective central panel 125*a*, 125*b* following therefrom by pressing the container against a respective region of glue G.

It will be understood that a different number of rows or arrangements of glue openings can be provided without departing from the disclosure, and that the central panels can be sized and configured to accommodate such arrangements. In one embodiment, the central panels 125*a*, 125*b* can be devoid of glue openings such that the respective containers CA1, CA2, CA3 and CB1, CB2, CB3 are adhered only to the respective central panel 125*a*, 125*b*. In another embodiment, glue G can be provided both on portions of the respective central panels 125*a*, 125*b* exposed through the respective glue openings 127*b*, 127*a* as well as portions of the respective central panels 125*a*, 125*b* adjacent the respective glue openings 127*a*, 127*b* such that each container CA1, CA2, CA3, CB1, CB2, CB3 can be adhered to portions of both central panels 125*a*, 125*b*.

The carrier 105/package 110 described above has a compact structure that can, for example, provide materials savings and waste reduction. Additionally, the arrangement of the glue G among the containers CA1, CA2, CA3, CB1, CB2, CB3 as well as the central panels 125*a*, 125*b* provides multiple points of attachment that results in a robust structure for holding and carrying the containers CA1, CA2, CA3, CB1, CB2, CB3. Further, the exposure of one or more portions of the containers CA1, CA2, CA3 CB1, CB2, CB3 on exterior portions of the carrier 105/package 110 provides a consumer with a clear view of labeling or surface graphics associated with the containers CA1, CA2, CA3, CB1, CB2, CB3, as well as providing convenient access to remove one or more of the containers CA1, CA2, CA3, CB1, CB2, CB3 from the carrier 105/package 110.

Figure 11:
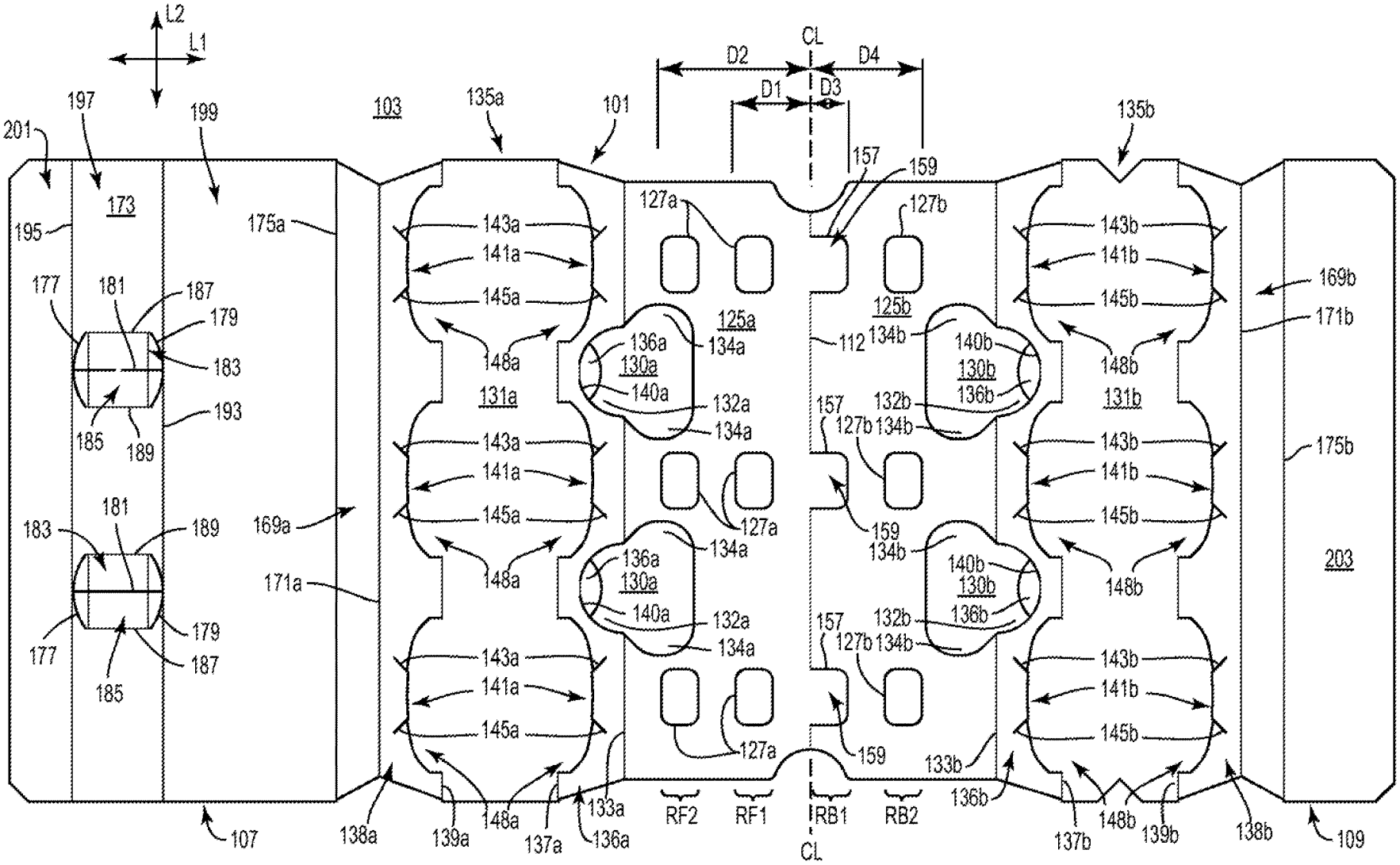
FIG. 11 is a plan view of an outer surface of a blank for forming a carrier and package according to a second exemplary embodiment of the disclosure.

Referring additionally to FIG. 11, a blank 203 for forming a carrier 205 according to a second exemplary embodiment of the disclosure is illustrated. The blank 203 and the carrier 205 can have one or more features that are similar to those of the blank 103 and the carrier 105 of the first exemplary embodiment, and like or similar reference numbers refer to like or similar features.

As shown, the attachment panels 131*a*, 131*b* of the blank 203 are each provided with a respective three laterally spaced cuts 141*a*, 141*b* such that the carrier 205 is sized and configured to support and retain six containers, with three containers CA1, CA2, CA3 in a front portion 206 of the carrier 205 and three containers CB1, CB2, CB3 in a back portion 208 of the carrier 205.

As also shown, the U-shaped cuts 157 interrupt the fold line 112 to define respective tabs 159 extending away from the centerline CL. Upon formation of a carrier from the blank 203, the tabs 159 can separate from the surrounding material of the central panel 125*b* at the respective cuts 157 to expose a pair of glue openings 127*b* of the first back row RB1.

It will be understood that the blanks and carriers described herein can be provided in different configurations without departing from the disclosure.

In general, the blank may be constructed from paperboard having a caliper so that it is heavier and more rigid than ordinary paper. The blank can also be constructed of other materials, such as cardboard, or any other material having properties suitable for enabling the carrier to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As described herein, a line of weakening can include one or more of tear lines, cut lines, etc. As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a plurality of panels comprising a top panel, at least one central panel, and at least one attachment panel configured to receive a portion of one or more containers of the plurality of containers, the at least one central panel is for being positioned between and attached to adjacent containers of the plurality of containers, the at least one central panel comprises a first row of openings and a second row of openings spaced apart from the first row of openings; and at least one access feature that is positionable for allowing access to at least one container of the plurality of containers, the at least one access feature comprises a marginal portion of the top panel and a marginal portion of the at least one attachment panel.

2. The carrier of claim 1, wherein the at least one central panel is for being adhered to adjacent containers of the plurality of containers.

3. The carrier of claim 1, wherein the at least one access feature is reconfigurable between a first configuration in which the marginal portion of the top panel is generally perpendicular to the at least one central panel, and a second configuration in which the marginal portion of the top panel and the marginal portion of the at least one attachment panel are raised to allow access to at least one container of the plurality of containers.

4. The carrier of claim 3, wherein the access feature further comprises a side panel foldably connected to the marginal portion of the top panel and the marginal portion of the at least one attachment panel.

5. The carrier of claim 4, wherein the marginal portion of the top panel overlaps the marginal portion of the at least one attachment panel.

6. The carrier of claim 4, wherein the marginal portion of the top panel is a first marginal portion of the top panel and the carrier further comprises a second marginal portion of the top panel, the at least one attachment panel is a front attachment panel and the carrier further comprises a back attachment panel, the at least one side panel is a front side panel and the carrier further comprises a back side panel foldably connected to the back attachment panel, the top panel comprises a central portion, the at least one access feature is a first access feature foldably connected to the central portion of the top panel at a first fold line, and the carrier further comprises a second access feature comprising the second marginal portion of the top panel and a marginal portion of the back attachment panel, the second access feature is foldably connected to the central portion of the top panel at a second fold line.

7. The carrier of claim 6, wherein the at least one central panel is a front central panel foldably connected to the front attachment panel, and the carrier further comprises a back central panel in at least partial contact with the front central panel and foldably connected to the back attachment panel.

8. The carrier of claim 1, wherein the first row of openings is spaced a first distance from a bottom edge of the at least one central panel, and the second row of openings is spaced a second distance from the bottom edge of the at least one central panel, the second distance is greater than the first distance.

9. The carrier of claim 8, wherein the at least one central panel is a front central panel, the plurality of panels further comprises a back central panel in contact with the front central panel, the at least one attachment panel is a front attachment panel foldably connected to the front central panel, and the plurality of panels further comprises a back attachment panel foldably connected to the back central panel, the plurality of openings is a first plurality of openings in the front central panel, and the back central panel comprises a second plurality of openings such that the first plurality of openings are in communication with the back central panel and the second plurality of openings are in communication with the front central panel.

10. The carrier of claim 1, wherein at least one of the at least one central panel and the at least one attachment panel includes at least one handle opening.

11. The carrier of claim 10, wherein the top panel comprises at least one handle feature, the at least one handle feature is aligned with the at least one handle opening.

12. A blank for forming a carrier for holding a plurality of containers, the blank comprising:

a plurality of panels comprising a top panel, at least one central panel, and at least one attachment panel, and at least one access feature comprising a marginal portion of the top panel and a marginal portion of the at least one attachment panel, the at least one access feature is for being positionable for allowing access to at least one container of the plurality of containers when the carrier is formed from the blank, the at least one central panel is for being positioned between and attached to adjacent containers of the plurality of containers when the carrier formed from the blank, the at least one central panel comprises a first row of openings and a second row of openings spaced apart from the first row of openings.

13. The blank of claim 12, wherein the at least one central panel is for being adhered to adjacent containers of the plurality of containers.

14. The blank of claim 12, wherein, when the carrier is formed from the blank, the at least one access feature is reconfigurable between a first configuration in which the marginal portion of the top panel is generally perpendicular to the at least one central panel, and a second configuration in which the marginal portion of the top panel and the marginal portion of the at least one attachment panel are raised to allow access to at least one container of the plurality of containers.

15. The blank of claim 14, wherein the access feature further comprises a side panel foldably connected to the marginal portion of the top panel and the marginal portion of the at least one attachment panel.

16. The blank of claim 15, wherein the marginal portion of the top panel is a first marginal portion of the top panel and the carrier further comprises a second marginal portion of the top panel, the at least one attachment panel is a front attachment panel and the carrier further comprises a back attachment panel, the at least one side panel is a front side panel and the carrier further comprises a back side panel foldably connected to the back attachment panel, the top panel comprises a central portion, the at least one access feature is a first access feature foldably connected to the central portion of the top panel at a first fold line, and the carrier further comprises a second access feature comprising the second marginal portion of the top panel and a marginal portion of the back attachment panel, the second access feature is foldably connected to the central portion of the top panel at a second fold line.

17. The blank of claim 16, wherein the at least one central panel is a front central panel foldably connected to the front attachment panel, and the carrier further comprises a back central panel foldably connected to the back attachment panel.

18. The blank of claim 12, wherein the first row of openings is spaced a first distance from a bottom edge of the at least one central panel, and the second row of openings is spaced a second distance from the bottom edge of the at least one central panel, the second distance is greater than the first distance.

19. The blank of claim 18, wherein the at least one central panel is a front central panel, the plurality of panels further comprises a back central panel, the at least one attachment panel is a front attachment panel foldably connected to the front central panel, and the plurality of panels further comprises a back attachment panel foldably connected to the back central panel, the plurality of openings is a first plurality of openings in the front central panel, and the back central panel comprises a second plurality of openings such that, when the carrier is formed from the blank, the first plurality of openings are in communication with the back central panel and the second plurality of openings are in communication with the front central panel.

20. The blank of claim 12, wherein at least one of the at least one central panel and the at least one attachment panel includes at least one handle opening.

21. The blank of claim 20, wherein the top panel comprises at least one handle feature for being aligned with the at least one handle opening when the carrier is formed from the blank.

22. A method of forming a carrier for holding a plurality of containers, the method comprising:

obtaining a blank comprising a plurality of panels comprising a top panel, at least one central panel, and at least one attachment panel, and at least one access feature comprising a marginal portion of the top panel and a marginal portion of the at least one attachment panel, the at least one central panel comprises a first row of openings and a second row of openings spaced apart from the first row of openings;

folding the plurality of panels such that the at least one central panel is positioned between adjacent containers of the plurality of containers; and attaching at least one container of the plurality of panels to the at least one central panel, the at least one access feature is positionable for allowing access to at least one container of the plurality of containers.

23. The method of claim 22, wherein the at least one central panel is for being adhered to adjacent containers of the plurality of containers.

24. The method of claim 22, wherein the at least one access feature is reconfigurable between a first configuration in which the marginal portion of the top panel is generally perpendicular to the at least one central panel, and a second configuration in which the marginal portion of the top panel and the marginal portion of the at least one attachment panel are raised to allow access to at least one container of the plurality of containers.

25. The method of claim 24, wherein the access feature further comprises a side panel foldably connected to the marginal portion of the top panel and the marginal portion of the at least one attachment panel.

26. The method of claim 25, wherein the marginal portion of the top panel overlaps the marginal portion of the at least one attachment panel.

27. The method of claim 25, wherein the marginal portion of the top panel is a first marginal portion of the top panel and the carrier further comprises a second marginal portion of the top panel, the at least one attachment panel is a front attachment panel and the carrier further comprises a back attachment panel, the at least one side panel is a front side panel and the carrier further comprises a back side panel foldably connected to the back attachment panel, the top panel comprises a central portion, the at least one access feature is a first access feature foldably connected to the central portion of the top panel at a first fold line, and the carrier further comprises a second access feature comprising the second marginal portion of the top panel and a marginal portion of the back attachment panel, the second access feature is foldably connected to the central portion of the top panel at a second fold line.

28. The method of claim 27, wherein the at least one central panel is a front central panel foldably connected to the front attachment panel, and the carrier further comprises a back central panel in at least partial face to face contact with the front central panel and foldably connected to the back attachment panel.

29. The method of claim 22, wherein the first row of openings is spaced a first distance from a bottom edge of the at least one central panel, and the second row of openings is spaced a second distance from the bottom edge of the at least one central panel, the second distance is greater than the first distance.

30. The method of claim 29, wherein the at least one central panel is a front central panel, the plurality of panels further comprises a back central panel in contact with the front central panel, the at least one attachment panel is a front attachment panel foldably connected to the front central panel, and the plurality of panels further comprises a back attachment panel foldably connected to the back central panel, the plurality of openings is a first plurality of openings in the front central panel, and the back central panel comprises a second plurality of openings such that the first plurality of openings are in communication with the back central panel and the second plurality of openings are in communication with the front central panel.

31. The method of claim 22, wherein at least one of the at least one central panel and the at least one attachment panel includes at least one handle opening.

32. The method of claim 31, wherein the top panel comprises at least one handle feature, the at least one handle feature is aligned with the at least one handle opening.

33. A package comprising:

a plurality of containers; and a carrier holding the plurality of containers, the carrier comprising:

a plurality of panels comprising a top panel, at least one central panel, and at least one attachment panel receiving a portion of one or more containers of the plurality of containers, the at least one central panel is positioned between and attached to adjacent containers of the plurality of containers, the at least one central panel comprises a first row of openings and a second row of openings spaced apart from the first row of openings; and at least one access feature that is positionable for allowing access to at least one container of the plurality of containers, the at least one access feature comprises a marginal portion of the top panel and a marginal portion of the at least one attachment panel.

34. The package of claim 33, wherein the at least one central panel is adhered to adjacent containers of the plurality of containers.

35. The package of claim 33, wherein the at least one access feature is reconfigurable between a first configuration in which the marginal portion of the top panel is generally perpendicular to the at least one central panel, and a second configuration in which the marginal portion of the top panel and the marginal portion of the at least one attachment panel are raised to allow access to at least one container of the plurality of containers.

36. The package of claim 35, wherein the access feature further comprises a side panel foldably connected to the marginal portion of the top panel and the marginal portion of the at least one attachment panel.

37. The package of claim 36, wherein the marginal portion of the top panel overlaps the marginal portion of the at least one attachment panel.

38. The package of claim 36, wherein the marginal portion of the top panel is a first marginal portion of the top panel and the carrier further comprises a second marginal portion of the top panel, the at least one attachment panel is a front attachment panel and the carrier further comprises a back attachment panel, the at least one side panel is a front side panel and the carrier further comprises a back side panel foldably connected to the back attachment panel, the top panel comprises a central portion, the at least one access feature is a first access feature foldably connected to the central portion of the top panel at a first fold line, and the carrier further comprises a second access feature comprising the second marginal portion of the top panel and a marginal portion of the back attachment panel, the second access feature is foldably connected to the central portion of the top panel at a second fold line.

39. The package of claim 38, wherein the at least one central panel is a front central panel foldably connected to the front attachment panel, and the carrier further comprises a back central panel in at least partial contact with the front central panel and foldably connected to the back attachment panel.

40. The package of claim 33, wherein the first row of openings is spaced a first distance from a bottom edge of the at least one central panel, and the second row of openings is spaced a second distance from the bottom edge of the at least one central panel, the second distance is greater than the first distance.

41. The package of claim 40, wherein the at least one central panel is a front central panel, the plurality of panels further comprises a back central panel in face to face contact with the front central panel, the at least one attachment panel is a front attachment panel foldably connected to the front central panel, and the plurality of panels further comprises a back attachment panel foldably connected to the back central panel, the plurality of openings is a first plurality of openings in the front central panel, and the back central panel comprises a second plurality of openings such that the first plurality of openings are in communication with the back central panel and the second plurality of openings are in communication with the front central panel.

42. The package of claim 33, wherein at least one of the at least one central panel and the at least one attachment panel includes at least one handle opening.

43. The package of claim 42, wherein the top panel comprises at least one handle feature, the at least one handle feature is aligned with the at least one handle opening.

* * * * *